United States Patent [19]

Brownbill et al.

[11] Patent Number: 4,561,463

[45] Date of Patent: Dec. 31, 1985

[54] SECTIONAL VALVE HAVING DUAL PRESSURE RELIEF

[75] Inventors: George A. Brownbill, Alvan Ley, England; James E. Olsen, Oconomowoc, Wis.

[73] Assignee: Koehring Company, Brookfield, Wis.

[21] Appl. No.: 592,936

[22] Filed: Mar. 23, 1984

[51] Int. Cl.[4] ..... F15B 13/08

[52] U.S. Cl. ..... 137/596.13; 137/596.12

[58] Field of Search ..... 137/596.12, 596.13

[56] References Cited

U.S. PATENT DOCUMENTS 3,324,881 6/1967 Keir ..... 137/596.13

3,324,882 6/1967 Keir ..... 137/596.13

3,416,561 12/1968 Kokaly ..... 137/596.13 X 3,811,471 5/1974 Murase et al. ..... 137/596.13

3,934,742 1/1976 Tennis ..... 137/596.12 X

*Primary Examiner*—Gerald A. Michalsky

*Attorney, Agent, or Firm*—Andrus, Sceales, Starke & Sawall

[57] ABSTRACT

A sectional valve having dual pressure relief provide high pressure relief for the hoist or lift function while auxiliary functions such as tilt, not requiring high pressure, are monitored by a low pressure relief valve. Spool position in one of the valve sections determined which functions become operative and which relief valve monitors the system.

5 Claims, 5 Drawing Figures

SECTIONAL VALVE HAVING DUAL PRESSURE RELIEF

PRIOR ART OF INTEREST

The following prior art is of interest to the present invention:

| U.S. Pat. No. | INVENTOR | ISSUE DATE |
|---|---|---|
| 3,324,881 | Keir | 06-13-67 |
| 3,324,882 | Keir | 06-13-67 |
| 3,416,561 | Kokaly | 12-17-68 |
| 3,811,471 | Murase et al | 05-21-74 |

BACKGROUND OF THE INVENTION

The present invention relates to hydraulic control valves and more particularly to a sectional valve having dual pressure relief.

Sectional hydraulic valves utilize multiple spools to control the various functions performed by hydraulic cylinders on forklift trucks, end loaders and similar machines. Typically, a single spool will control a cylinder for a particular function such as hoist (lift), tilt or an auxiliary function.

In lift truck applications it is desirable to make available fluid pressure for the hoist or lift function that is greater than the fluid pressure needed for the tilt or auxiliary functions. Typically, a hoist or lift pressure of 2,000 psi is desirable while a tilt or auxiliary function pressure of 1,900 psi is desirable.

Valve systems such as those shown in the U.S. Pat. Nos. 3,324,881, and 3,324,882 patents to Keir utilize a pair of pilot valves that are operable at different pressures and which in turn cause operation of a main relief valve.

While the dual pressure relief valve system of the Kokaly U.S. Pat. No. 3,416,561 patent shows the use of a single relief valve which operates at two different pressures. The Kokaly relief valve is used to monitor two sides of a single circuit (raise and lower).

The Murase et al. U.S. Pat. No. 3,811,471 patent also utilizes two pilot relief valves and one main relief valve.

The prior art has also obtained dual pressure relief by utilizing a special external line which will deliver fluid at high pressure in the hoist circuit when desired. All of the above methods and arrangements require additional parts, i.e. pilot valves or external circuitry which add to the cost of the valve.

SUMMARY OF THE INVENTION

A sectional valve having dual pressure relief includes at least one valve section which provides fluid at high pressure such as for the hoist or lift function. A first relief valve limits the system pressure in the valve sections requiring high pressure.

Valve sections downstream from the high pressure valve sections operate additional functions that do not require high fluid pressure. A second relief valve having a pressure limit lower than that of the first relief valve limits the system pressure in the downstream valve sections.

The spool position in a valve section at the boundary between the high pressure and low pressure sections determines which of the relief valves is selected to monitor system pressure.

The present invention thus eliminates the need for special external lines for delivery of the high pressure fluid.

The present invention also provides a sectional valve assembly that can monitor a high pressure function and any number of low pressure functions while utilizing only two relief valves.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
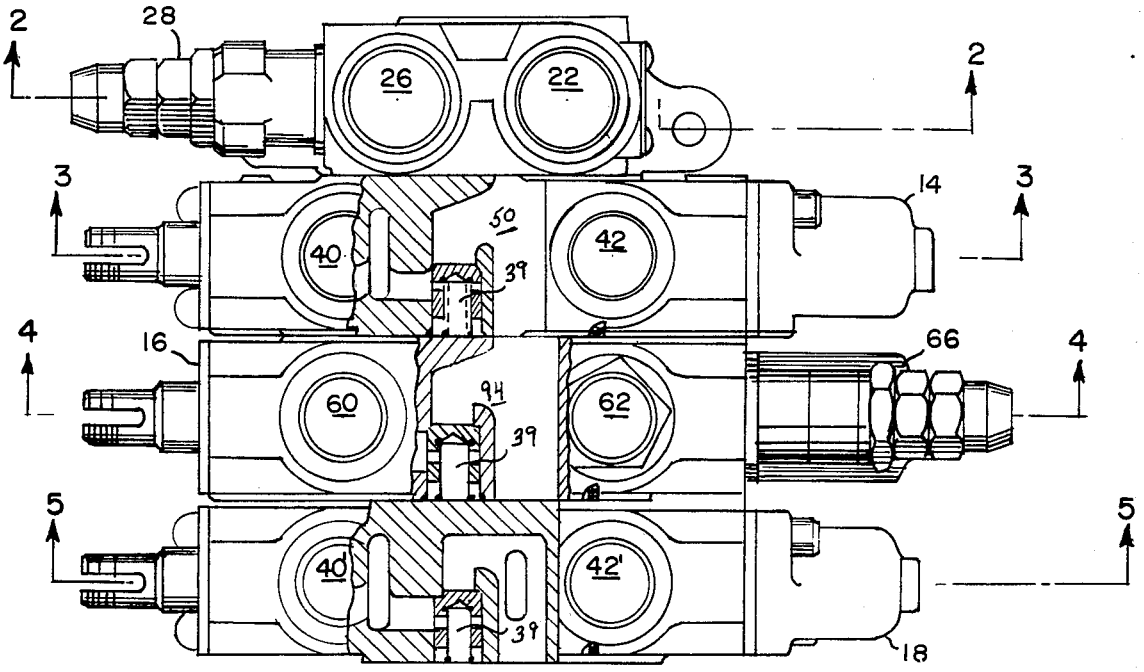
FIG. 1 is a plan view of a sectional valve embodying the principles of the invention.

FIG. 1 shows a sectional valve 10 comprised of an inlet and outlet manifold section 12 which provides pressurized hydraulic fluid from pump 20 to the downstream sections of the valve and which returns exhaust fluid to reservoir 24.

The remainder of sectional valve 10 is shown as being comprised of functional valve sections 14, 16 and 18. While the sectional valve is shown as having only three sections beyond the inlet, it should be appreciated and understood that additional valve sections may be easily added to sectional valve 10 so as to provide additional functions or controls.

Figure 2:
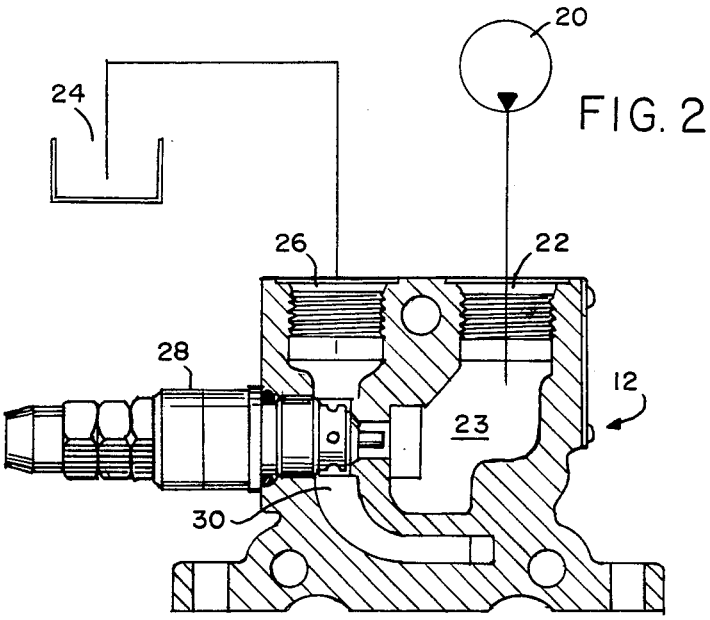
FIG. 2 is a sectional view along line 2—2 of FIG. 1.

As seen in FIG. 2, inlet manifold section 12 receives pressurized hydraulic fluid from pump 20 via inlet port 22 and returns exhausted hydraulic fluid to reservoir 24 via outlet port 26.

Relief valve 28 is disposed within passageway 30 and monitors fluid pressure in passageway 23.

Figure 3:
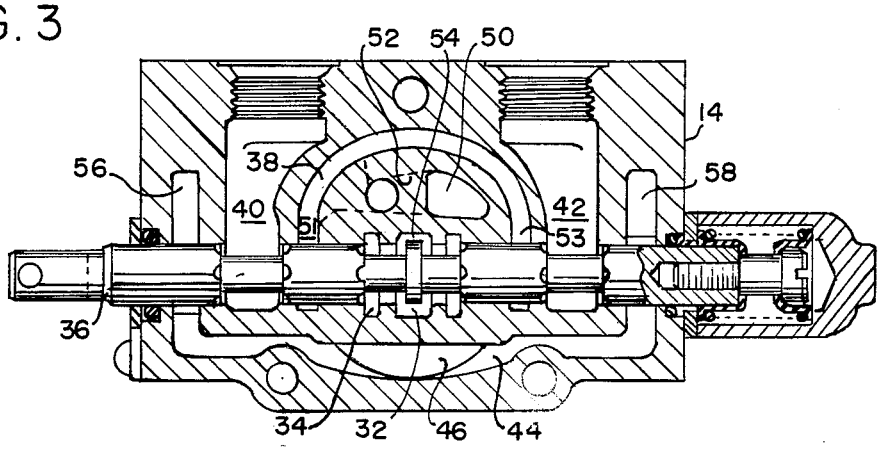
FIG. 3 is a sectional view along line 3—3 of FIG. 1.

As shown in FIG. 3, first downstream valve section 14 is a typical open center control valve characterized by an open center or through passage 32 that intersects bore 34 which houses spool 36.

Also formed in valve body 14 are U-shaped bridge passage 38, a pair of service passages 40 and 42 and a return fluid passage 44 communicable with outlet passage 46 that leads to passageway 30 in inlet section 12 and eventually to reservoir 24 via outlet port 26.

The U-shaped bridge passage 38 has its bight portion communicated with feeder passage 50 through feeder branch 52. Feeder passage 50 also connects with the inlet of the valve in the conventional manner. The legs of bridge passage 38 intersect spool bore 34 at zones 51 and 53 spaced at opposite sides of medial branch 54 of the open center passage. Hence when communication between the upstream and downstream sections of the open center passage through the medial portion 54 of spool bore 34 is blocked due to the shifting of spool 36 out of its neutral position, pressure fluid is diverted into feeder passage 50 from whence it flows through feeder branch 52 to the bridge passage 38, past a check valve 39, all in the conventional manner.

The two service passages 40 and 42 intersect spool bore 34 at a zone spaced axially outwardly along said bore from its zone of intersection with the legs of bridge passage 38 and thus each service passage is communicable through a short section of the spool bore with its adjacent leg of the bridge passage. The exhaust passage 44 comprises a substantially U-shaped passage, the legs 56 and 58 of which intersect the spool bore 34 near the opposite ends thereof and the bight portion of which communicates with the outlet passage 46. Hence, each of the service passages 40 and 42 is also communicable through another short section of the spool bore with its adjacent leg of the exhaust passage. Pressure relief valve 28 monitors pressure in ports 40 and 42 of the system governed by the first valve section 14, and as explained hereinafter, it also monitors pressure of port 60 in second valve section 16.

In accordance with the invention second downstream valve section 16 is also an open center control valve having service ports 60 and 62 wherein service port 60 is a hoist lift port which provides high pressure hydraulic fluid to an hydraulic cylinder utilized in performing the lift or hoist function, while service port 62 is blocked by plug 64. Relief valve 66 which is set at a lower pressure than relief valve 28 is disposed within passageway 68 so as to monitor fluid pressure in that passageway.

Valve section 16 is provided with a specially designed spool 70 disposed within bore 72.

Spool 70 is provided with spaced lands 74, 76, 78 and 80 and reduced diameter portions 82, 84, 86 and 88.

Figure 4:
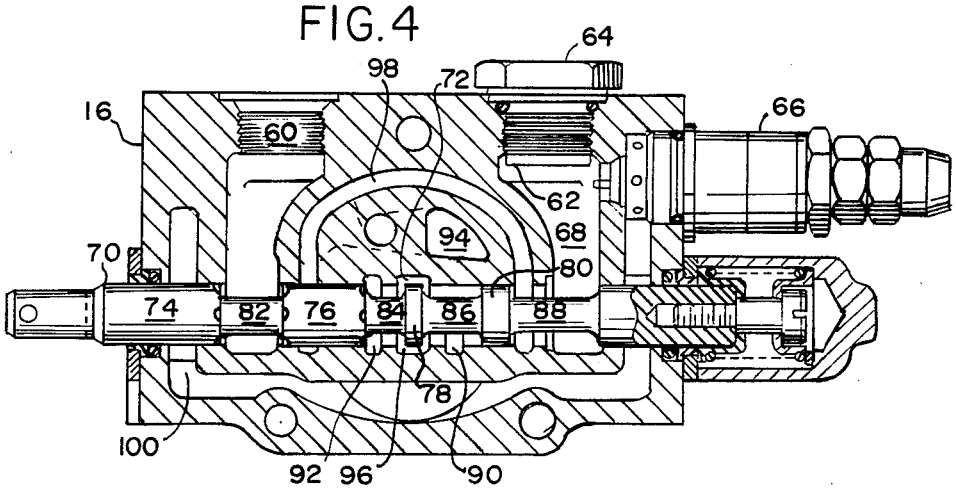
FIG. 4 is a sectional view along line 4—4 of FIG. 1.
Figure 5:
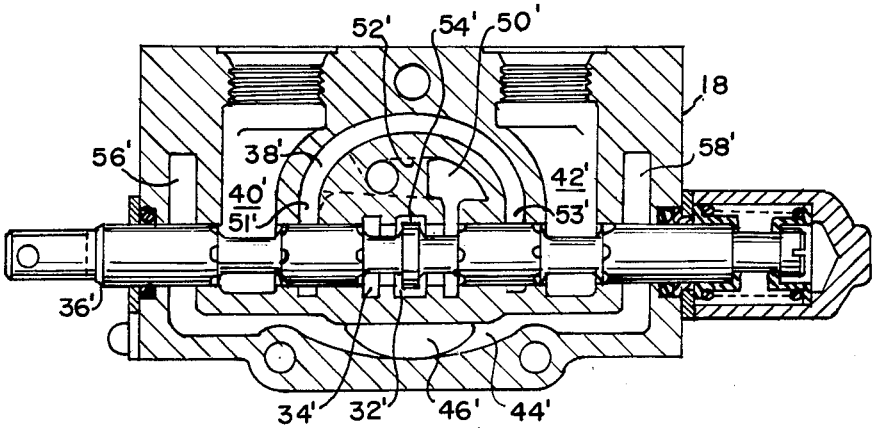
FIG. 5 is a sectional view along line 5—5 of FIG. 1.

When spools 36 and 70 are in neutral positions, as seen in FIGS. 3 and 4, pump 20 supplies fluid to open center sections 90 and 92 in bore 72 and in turn to feeder passage 94 which is connected to bridge passage 98. The fluid then proceeds to open center 96 from whence it either returns to reservoir 24 or is utilized by downstream valve section 18 in the conventional manner. Should the fluid's return to reservoir 24 be obstructed by a downstream use in valve section 18 the resulting pressure build-up will be realized in feeder passage 94 and bridge passage 98. This pressure is communicated to passageway 68 via reduced diameter section 88 and is thus monitored by relief valve 66.

When spool 70 is moved to its extreme left hand or out position, service port 60 is vented to reservoir 24 via reduced diameter section 82 and exhaust passage 100, while land 76 prevents fluid from entering service port 60 from bridge passage 98. Fluid from section 90 is allowed into open center 96 from whence it can flow to downstream valve section 18. Should the fluid be utilized by downstream section 18 the resulting pressure build-up is monitored by relief valve 66 as described earlier.

When spool 70 is moved to its extreme right hand or in position, fluid is provided to sections 90 and 92 and to feeder passage 94. Land 76 prevents fluid flow from section 92 to open center 96 while land 78 prevents fluid flow from branch 90 to open center branch 96 and thus downstream section 18 becomes inoperative. Pressurized fluid flows from bridge passage 98 to service port 60 via reduced portion 82 while land 74 prevents the exhaust of fluid from port 60. The flow of fluid from bridge passage 98 to passageway 68 is prevented by land 80 and thus the pressure in the system is monitored by relief valve 28.

As mentioned earlier relief valve 28 is set as a considerably higher pressure (greater than 2000 psi) than relief valve 66 (1900 psi or less). Typically the hoist or lift function requires a higher pressure than auxiliary function such as tilt or rotate.

In the sectional valve of the invention, the hoist or lift function is provided at service port 60. As discussed earlier when fluid is provided to service port 60 relief valve 66 is effectively removed from the system and system pressure is monitored by relief valve 28. Since supplying fluid to service port 60 makes all downstream valve sections which perform auxiliary functions inoperative, there is no need for relief valve 66.

Whenever spool 70 is in a position allowing fluid flow to downstream sections performing auxiliary functions the system pressure is monitored by relief valve 66.

In accordance with the invention third downstream valve section 18 provides auxiliary functions and is a typical open center control valve such as valve section 14. Accordingly, parts of valve section 18 corresponding to identical parts on valve section 14 have been given identical numbers primed.

It is also to be understood that any number of high pressure valve sections may be placed upstream of valve section 16 and will have the pressure monitored by relief valve 28 provided that section 16 uses a housing circuit configuration similar to section 18.

Various modes for carrying out the invention are contemplated as being within the scope of the following claims particularly pointing out and distinctly claiming the subject matter which is regarded as the invention.

We claim:

1. A control valve of the type having upstream and downstream valve elements to govern separate fluid pressure operated systems, an open center passage intersected by said valve elements, and wherein each of said valve elements is movable from a neutral position to an operating position to effect communication of an associated service passage with a pressure fluid supply passage, said control valve being characterized by:

the service passage associated with the downstream valve element receiving pressure fluid from the open center passage in said operating position of the downstream valve element;

a pair of relief valves, one for each of said fluid pressure operated systems and one of said relief valves being set to relieve at a higher pressure than the other relief valve;

means providing a chamber into which said other relief valve projects to be acted upon by pressure of fluid therein;

means rendered effective by the upstream valve element in said operating position thereof for isolating said other relief valve from fluid pressure then present in the system governed by said upstream valve element so that the pressure in its associated service passage is then monitored solely by said one relief valve;

means on said upstream valve element for closing off the supply of pressure fluid to the downstream valve element via the open center passage in said operating position of the upstream valve element so as to then render the downstream valve element ineffective; and means rendered operative to effect communication of said chamber with the service passage associated with the downstream valve element via the open center passage whenever the downstream valve element is in its said operating position and the upstream valve element is in its neutral position.

2. The control valve of claim 1 further characterized by:

said upstream valve element movable to a second operating position to communicate a second service passage with the pressure fluid supply passage;

a plug closing said second service passage to prevent egress of fluid therefrom; and said second service passage providing said chamber into which said other relief valve projects.

3. The control valve of claim 2 further characterized by:

means on said upstream valve element for effecting communication of said pressure fluid supply with said downstream valve element via the open center passage in said second operating position.

4. The control valve of claim 2 further characterized by:

means on said upstream valve element for effecting communication of said service passage with a reservoir in said second operating position.

5. The control valve of claim 1 further characterized by:

means on said upstream valve element for closing off the supply of pressure fluid to its associated service passage in said neutral position.

* * * * *